US005162849A

United States Patent [19]

Yoshino et al.

[11] Patent Number: 5,162,849

[45] Date of Patent: Nov. 10, 1992

[54] IMAGE FORMING APPARATUS HAVING A DEVELOPER DETERIORATION DETECTING DEVICE

[75] Inventors: Kunihisa Yoshino; Mitsuo Motohashi; Yukio Okamoto; Takahiro Tuchiya; Jun-ichi Hamada, all of Hachioji, Japan

[73] Assignee: Konica Corporation, Tokyo, Japan

[21] Appl. No.: 793,618

[22] Filed: Nov. 18, 1991

[30] Foreign Application Priority Data

Nov. 23, 1990 [JP] Japan ..... 2-319958
Nov. 23, 1990 [JP] Japan ..... 2-319959
Nov. 23, 1990 [JP] Japan ..... 2-319961

[51] Int. Cl.[5] ..... G03G 15/08; G03G 15/00

[52] U.S. Cl. ..... 355/207; 355/246; 355/296; 355/326

[58] Field of Search ..... 355/205, 206, 207, 208, 355/246, 296, 326

[56] References Cited

U.S. PATENT DOCUMENTS 4,331,184 5/1982 Terashima et al. ..... 355/246 X
4,963,927 10/1990 Ishihara ..... 355/207

FOREIGN PATENT DOCUMENTS 61-232479 10/1986 Japan ..... 355/205
63-235971 9/1988 Japan ..... 355/246
1-229276 9/1989 Japan ..... 355/246

*Primary Examiner*—Joan H. Pendegrass
*Attorney, Agent, or Firm*—Frishauf, Holtz, Goodman & Woodward

[57] ABSTRACT

An image forming apparatus which detects deterioration of developer contained in a developing unit, and if it is the case, the toner is discharged out of the developing unit through a surface of an image carrying member. The apparatus is provided with a sensor to measure toner concentration in developer contained in the developing unit, a drive controller to control a supply amount of toner into the developing unit based on the toner concentration, a calculating unit to obtain average toner supply during a predetermined period, a detecting unit to detect the deterioration of the developer by comparing the average toner supply with a reference data stored in a memory.

13 Claims, 15 Drawing Sheets

FIG. 11

[LOOK UP TABLE 1]

| SENSOR OUTPUT VOLTAGE | MOTOR DRIVING TIME INTERVAL |
|---|---|
| 0 V | 0 SEC |
| 1.9 V | 0.24 SEC |
| 2.0 V | 0.48 SEC |
| 2.1 V | 0.72 SEC |
| 2.2 V | 0.96 SEC |
| 2.3 V | 1.20 SEC |
| 2.4 V | 2.00 SEC |

FIG. 12

[LOOK UP TABLE 2]

| SENSOR OUTPUT VOLTAGE | MOTOR DRIVING TIME INTERVAL |
|---|---|
| 0 V | 0 SEC |
| 2.05 V | 0.24 SEC |
| 2.15 V | 0.48 SEC |
| 2.25 V | 0.72 SEC |
| 2.35 V | 0.96 SEC |
| 2.45 V | 1.20 SEC |
| 2.55 V | 2.00 SEC |

FIG. 13

[LOOK UP TABLE 3]

| SENSOR OUTPUT VOLTAGE | MOTOR DRIVING TIME INTERVAL |
|---|---|
| 0 V | → 0 SEC |
| 2.2 V | → 0.24 SEC |
| 2.3 V | → 0.48 SEC |
| 2.4 V | → 0.72 SEC |
| 2.5 V | → 0.96 SEC |
| 2.6 V | → 1.20 SEC |
| 2.7 V | → 2.00 SEC |

FIG. 14

[LOOK UP TABLE 4]

| SENSOR OUTPUT VOLTAGE | MOTOR DRIVING TIME INTERVAL |
|---|---|
| 0 V | → 0 SEC |
| 2.35 V | → 0.24 SEC |
| 2.45 V | → 0.48 SEC |
| 2.55 V | → 0.72 SEC |
| 2.65 V | → 0.96 SEC |
| 2.75 V | → 1.20 SEC |
| 2.85 V | → 2.00 SEC |

FIG. 16

| NUMBER OF COPIED SHEETS | CONTROL VOLTAGE |
|---|---|
| 1 ~ 5000 | 7.02 V |
| 5001 ~ 10000 | 6.94 V |
| 10001 ~ 15000 | 6.86 V |
| 15001 ~ 20000 | 6.78 V |

FIG. 17

[LOOK UP TABLE 1']

| SENSOR OUTPUT VOLTAGE | MOTOR DRIVING TIME INTERVAL |
|---|---|
| 0 V | |
| | → 0 SEC |
| 1.7 V | |
| | → 0.24 SEC |
| 1.8 V | |
| | → 0.48 SEC |
| 1.9 V | |
| | → 0.72 SEC |
| 2.0 V | |
| | → 0.96 SEC |
| 2.1 V | |
| | → 1.20 SEC |
| 2.2 V | |
| | → 2.00 SEC |

FIG. 18

[LOOK UP TABLE 2]

| SENSOR OUTPUT VOLTAGE | MOTOR DRIVING TIME INTERVAL |
|---|---|
| 0 V | 0 SEC |
| 1.85 V | 0.24 SEC |
| 1.95 V | 0.48 SEC |
| 2.05 V | 0.72 SEC |
| 2.15 V | 0.96 SEC |
| 2.25 V | 1.20 SEC |
| 2.35 V | 2.00 SEC |

FIG. 19

[LOOK UP TABLE 3]

| SENSOR OUTPUT VOLTAGE | MOTOR DRIVING TIME INTERVAL |
|---|---|
| 0 V | 0 SEC |
| 2.0 V | 0.24 SEC |
| 2.1 V | 0.48 SEC |
| 2.2 V | 0.72 SEC |
| 2.3 V | 0.96 SEC |
| 2.4 V | 1.20 SEC |
| 2.5 V | 2.00 SEC |

[LOOK UP TABLE 4'

| SENSOR OUTPUT VOLTAGE | MOTOR DRIVING TIME INTERVAL |
|---|---|
| 0 V | 0 SEC |
| 2.15 V | 0.24 SEC |
| 2.25 V | 0.48 SEC |
| 2.35 V | 0.72 SEC |
| 2.45 V | 0.96 SEC |
| 2.55 V | 1.20 SEC |
| 2.65 V | 2.00 SEC |

IMAGE FORMING APPARATUS HAVING A DEVELOPER DETERIORATION DETECTING DEVICE

BACKGROUND OF THE INVENTION

The present invention relates to a developer deterioration detecting device which detects the deterioration of developer held in a developing means installed in an image forming apparatus which obtains an image in such a manner that: a toner image is formed on a photordceptor by an electrophotographic system; and the obtained toner image is transferred onto a transfer sheet.

Image formation by the electrophotographic system is conducted in such a manner that: a latent image corresponding to a document image or image data is formed on a photoreceptor; the formed latent image is developed so that a toner image is formed on the photoreceptor; and then the toner image is transferred onto a transfer sheet.

In a developing means which visualizes the latent image formed on the photoreceptor, one-component developer including only toner or two-component developer including toner and carrier is provided, and when the formed latent image is visualized, only toner is moved from the developing means to the photoreceptor so that a toner image can be formed on the photoreceptor.

In general, in the case of either one-component developer or two-component developer, the developer is stirred in the developing means in order to give an electric charge to the developer by means of frictional charging. In the case of a one-component developer, the amount of toner, which functions as developer, is detected by a sensor and controlled so that a constant amount of toner can be held in the developing means. In the case of two-component developer, the toner concentration, which is the ratio of toner to carrier, is measured by a toner concentration sensor. When it has been detected by the toner concentration sensor that the toner concentration in the developing means is low, new toner is supplied to the developing means. In the manner described above, toner concentration in the developing means is controlled so that it can be maintained constant. As mentioned before, in the case of one-component developer, the amount of toner is controlled, and in the case of two-component developer, the concentration of toner is controlled. The reason why control is conducted in the manner described above, is to maintain the developing performance constant in order to form an image of high quality.

However, since the toner amount is maintained constant in the case of one-component developer and the toner concentration is maintained constant in the case of two-component developer, the deterioration of developer is caused in such a manner that: when toner consumption is small in a developing means, that is, when the visualization area is small in an image formation, a large amount of toner stays in the developing means; accordingly, the toner in the developing means is stirred over a long period of time; and as a result, deterioration of toner such as an increase in electric charge given to the toner and a decrease in fluidity, is caused.

In the case of a conventional image forming apparatus, consideration has not been given to the aforementioned deterioration in toner.

When toner is deteriorated, the fluidity is lowered, so that the toner can not be stably moved from the developing means to the photoreceptor. As a result, the following problems are caused: Toner image density is lowered. The density of the toner image becomes too high. Fogging occurs in the image. Character images become too bold. Especially, in the case of color image formation, reproducibility of color is extremely lowered, so that developing performance is lowered or becomes unstable and image quality is degraded.

In order to detect toner concentration, there is a toner amount detecting system in which inductance is utilized for detection. Toner concentration can be detected by the aforementioned system as follows. Since carrier contained in developer is magnetic, toner concentration can be detected with an inductance sensor having a coil installed in the developer. Specifically, toner concentration can be found as follows: consideration is given to the phenomenon in which permeability of developer is varied when the mixing ratio of toner to carrier varies according to the fluctuation in toner concentration; and toner concentration can be found y measuring the permeability of developer.

In the aforementioned method, output voltage of the aforementioned inductance sensor is compared with a reference voltage, and toner is supplied so that the output voltage of the inductance sensor can be the same as the reference voltage. As a result, toner concentration can be controlled to be constant. The aforementioned technique has been disclosed in the official gazettes of Japanese Patent Application Nos. 28305/1988 and 5299/1989.

FIG. 21 is a characteristic diagram showing an example of an inductance sensor. The sensor shown in the diagram is characterized in that: when toner concentration is lowered, output voltage of the sensor is increased. Output voltage can be adjusted when control voltage $V_c$ given to the sensor is changed. In the initial setting, control voltage $V_c$ is determined so that a predetermined voltage, for example 2 V, can be obtained when toner concentration is the same as the reference concentration, for example, 7%. In this diagram, control voltage is $V_{c2}$, which is supplied continuously.

In a color copier, various colors are reproduced by superimposing 4 colors of yellow, cyan, magenta and black. Consequently, the toner concentration of each color must be accurately controlled in order to maintain the color balance.

While developer is being used, its apparent density (which is the weight of developer per unit volume) is varied. When stirring and circulation are repeated in a developing unit, the developer is compressed as compared to the initial state, although the reverse behavior is shown, depending on the kind of developer. In the aforementioned compressed state, the amount of toner per unit volume and that of carrier per unit volume are increased. However, toner concentration is detected only by the amount of carrier, so that the output of the sensor is increased and toner concentration is mistakenly judged to have been lowered.

Therefore, there is a possibility that toner is supplied in the developing unit and toner concentration becomes excessively high. Due to the foregoing, the density of the outputted image becomes too high. In this case, the developing condition of each color developer is different, so that the color balance is upset and color reproducibility is deteriorated.

An object of the present invention is to solve the aforementioned problems. It is a primary object of the present invention to provide a developer deterioration detecting method of an image forming apparatus in which the deterioration of developer can be simply and accurately detected in a manner in which the amount of toner supply is calculated as the toner consumption, utilizing a conventional toner supply means. Another object of the present invention is to provide an image forming apparatus in which the degradation of developing performance, image quality and color reproducibility can be forestalled.

A further object of the present invention is to realize an image forming apparatus in which toner concentration can be accurately detected and always maintained constant regardless of the developing condition of the image forming apparatus.

SUMMARY OF THE INVENTION

The aforementioned object of the present invention can be accomplished by a developer deterioration detecting method of an image forming apparatus characterized in that: while an electrostatic latent image formed on a photoreceptor is being visualized by a developing means, toner concentration of developer held in the developing means is measured; toner is supplied to the developing means according to the output of the measurement; the consumption of toner consumed in the developing means is calculated from the output value; and the calculated toner consumption is compared with a reference value which has been previously set so as to detect the deterioration of developer in the developing means.

The aforementioned object of the present invention can be accomplished by a developer deterioration detecting method of an image forming apparatus characterized in that: while an electrostatic latent image formed on a photoreceptor is being visualized by a developing means, toner concentration of developer held in the developing means is measured; a toner supply means is driven for a drive time corresponding to the measured value of toner concentration; a supply amount of toner supplied during the drive time is compared with a reference value which has been previously set so as to detect the deterioration of developer in the developing means.

The aforementioned object can be accomplished by an image forming apparatus, comprising: a sensor which detects toner concentration in a developer including magnetic carrier and nonmagnetic toner, as a variation of permeability determined by a ratio of magnetic carrier contained in a constant volume of developer; a using condition detecting means to detect a using condition of developer; and a control means which varies the control level according to a using condition of developer and controls toner supply.

BRIEF DESCRIPTION OF THE DRAWINGS

FIG. 11 is a schematic illustration showing the content of the first table which is stored in a look-up table 603 illustrated in FIG. 10;

FIG. 12 is a schematic illustration showing the content of the second table in the look-up table 603;

FIG. 13 is a schematic illustration showing the content of the third table in the look-up table 603;

FIG. 14 is a schematic illustration showing the content of the fourth table in the look-up table 603;

FIG. 16 is a schematic illustration to explain control voltage applied to the control system of the developing unit shown in FIG. 15;

FIG. 17 is a schematic illustration showing the content of Table 1' used under a condition of high temperature and humidity;

FIG. 18 is a schematic illustration showing the content of Table 2' used under a condition of high temperature and humidity;

FIG. 19 is a schematic illustration showing the content of Table 3' used under a condition of high temperature and humidity;

DETAILED DESCRIPTION OF THE PREFERRED EMBODIMENTS

With reference to the attached drawings, embodiments of the present invention will be explained as follows.

Figure 1:
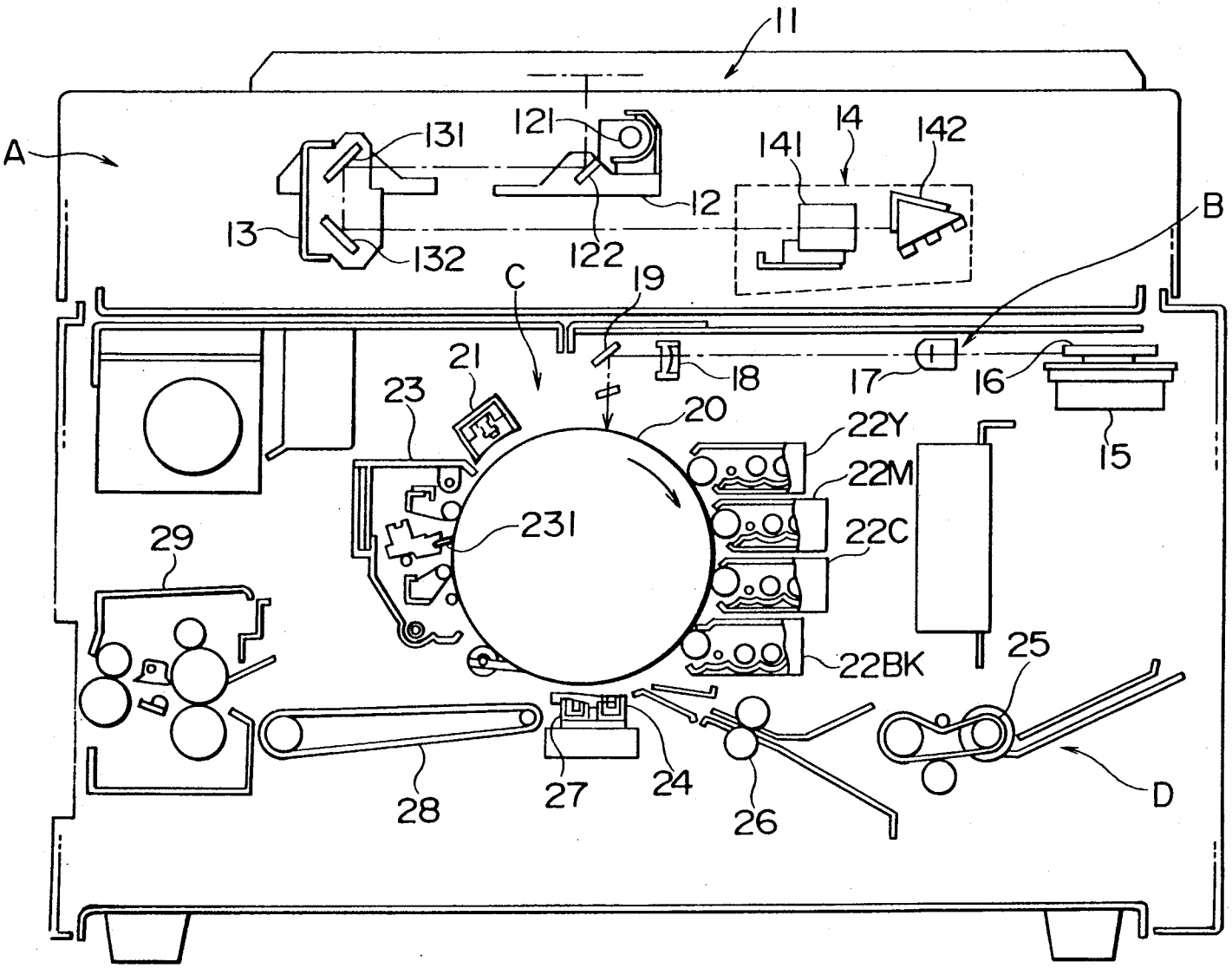
FIG. 1 is a sectional view of essential portions of a color image forming apparatus, which is a color copier provided with an embodiment of the present invention.

FIG. 1 is a sectional view of essential portions of a color image forming apparatus, which is a color copier provided with an embodiment of the present invention. This color copier comprises image reading system A, laser writing system B, image forming system C, and paper supply system D. In the color copier, a color image is formed according to the following processes.

First, in image reading system A, a document placed on a platen 11 is irradiated with a halogen lamp 121 mounted on a carriage 12 which slides horizontally. Mirrors 131, 132 are mounted on a movable mirror unit 13 which is moved horizontally. In combination with a mirror 122 mounted on the aforementioned carriage 12, the mirrors 131, 132 send an optical image of the document to an image reading section 14.

The aforementioned carriage 12 and movable mirror unit 13 are driven by a stepping motor through a wire, wherein both the stepping motor and wire are not shown in the drawing. The carriage 12 is slid at a speed of V in the same direction as the movable mirror unit 13 which is slid at a speed of 1/2 V.

The aforementioned image reading section 14 is composed of a lens 141 and a color CCD 142 installed on the back of the lens 141. The optical image transmitted by the aforementioned mirrors 121, 131, 132 is converged upon an image receiving surface of the color CCD 142 by the aforementioned lens 141, so that the optical image is formed.

Color separation is conducted on the document image by the aforementioned color CCD 142, so that the color image data of blue (B), green (G), and red (R) can be obtained. Then, color signals are outputted on which color correction has been conducted by an image processing means (not illustrated in the drawing) according to the toner colors of yellow (Y), magenta (M), cyan (C), and black (B), wherein the toners of these colors are provided in the developing means. Then, the color signals are inputted into laser writing unit B which is an exposure means.

In laser writing system B, operations are conducted as follows:

A laser beam generated by a semiconductor laser (not illustrated in the drawing) is rotatively scanned by a polygonal mirror 16 rotated by a drive motor 15; the laser beam passes through an $f\theta$ lens 17 and cylindrical lens 18; the optical path of the laser beam is curved by a mirror 19; and the laser beam is projected on the circumferential surface of a photoreceptor drum 20 which has been uniformly charged with a predetermined electrical charge by a charging unit 21 so that a bright line can be formed.

Concerning the auxiliary scanning direction, an index (not shown in the drawing) provided in a specific position on the photoreceptor drum 20 is detected by a photosensor (not shown in the drawing), and an operation to modulate the semiconductor by the image signal is started in accordance with the detection signal. Concerning the primary scanning direction, the laser beam is detected by an index sensor (not shown in the drawing), and the modulated laser beam scans the circumferential surface of the photoreceptor drum 20. Consequently, a latent image corresponding to the first color is formed on the circumferential surface of the photoreceptor drum 20 by the primary scanning conducted by the laser beam and the auxiliary scanning conducted by rotation of the photoreceptor drum 20. The formed latent image is developed by a developing unit, for example, a developing unit 22Y in which yellow (Y) toner is provided, so that a Y-toner image is formed on the surface of the photoreceptor drum 20. The obtained toner image is held on the surface of the photoreceptor drum 20 and passes under a cleaning means 23 which is separated from the circumferential surface of the photoreceptor drum 20, and then the process enters into the following copy cycle to form an image of the second color.

The image of the second color is formed as follows: The photoreceptor drum 20 on which the Y-toner image has been formed, is charged again by the charging unit 21. The second color signal outputted from image reading system A, is inputted into laser writing system B, and writing is conducted on the surface of the photoreceptor drum 20 in the same manner as the aforementioned first color signal, so that a latent image of the second color is formed. The latent image is developed by a developing unit of the second color, for example, a developing unit 22M in which toner of magenta is provided. This M-toner image is formed in the presence of the Y-toner image.

In the same manner as described above, a latent image formed by an image signal of the third color is developed by a developing unit 22C in which cyan (C) toner is provided. Further, a latent image formed by an image signal of the fourth color is developed by a developing unit 22Bk in which black (Bk) toner is provided so that a Bk toner image can be superimposed on the surface of the photoreceptor drum 20. In the manner described above, a color toner image is formed on the surface of the photoreceptor drum 20.

A DC bias and/or an AC bias is impressed upon a developing sleeve 221 of each of the developing units 22Y, 22M, 22C, 22Bk, and reversal development (jumping development) is conducted on the photoreceptor drum 20 under a non-contacting condition. Rotation of a developing sleeve of a developing unit which does not participate in development is stopped, and the bias of the aforementioned developing unit is cut off, so that a toner image formed on the photoreceptor drum 20 is not damaged, and unnecessary toner is not supplied to the latent image.

The color toner image formed on the surface of the photoreceptor drum 20 in the manner described above, is transferred by a transfer unit 24 onto a transfer sheet which is conveyed by a paper supply belt 25 of paper supply system D and fed by a timing roller 26 in synchronization with the aforementioned color toner image. A high voltage of a polarity reverse to that of toner is impressed upon the transfer unit 24 so that the toner image can be transferred.

The transfer sheet onto which a color toner image has been transferred, is separated from the surface of the photoreceptor drum and conveyed to a fixing unit 29 by a conveyance belt 28 so that the color toner image is fixed, and then the transfer sheet is discharged from the apparatus.

After the transfer operation has been completed, the photoreceptor drum 20 is further rotated clockwise, and a blade 231 of the cleaning means 23 is contacted with the surface of the photoreceptor drum 20 so that the residual toner can be removed. After cleaning, the blade 231 is separated from the photoreceptor drum 20, and a new copying process is started.

Figure 2:
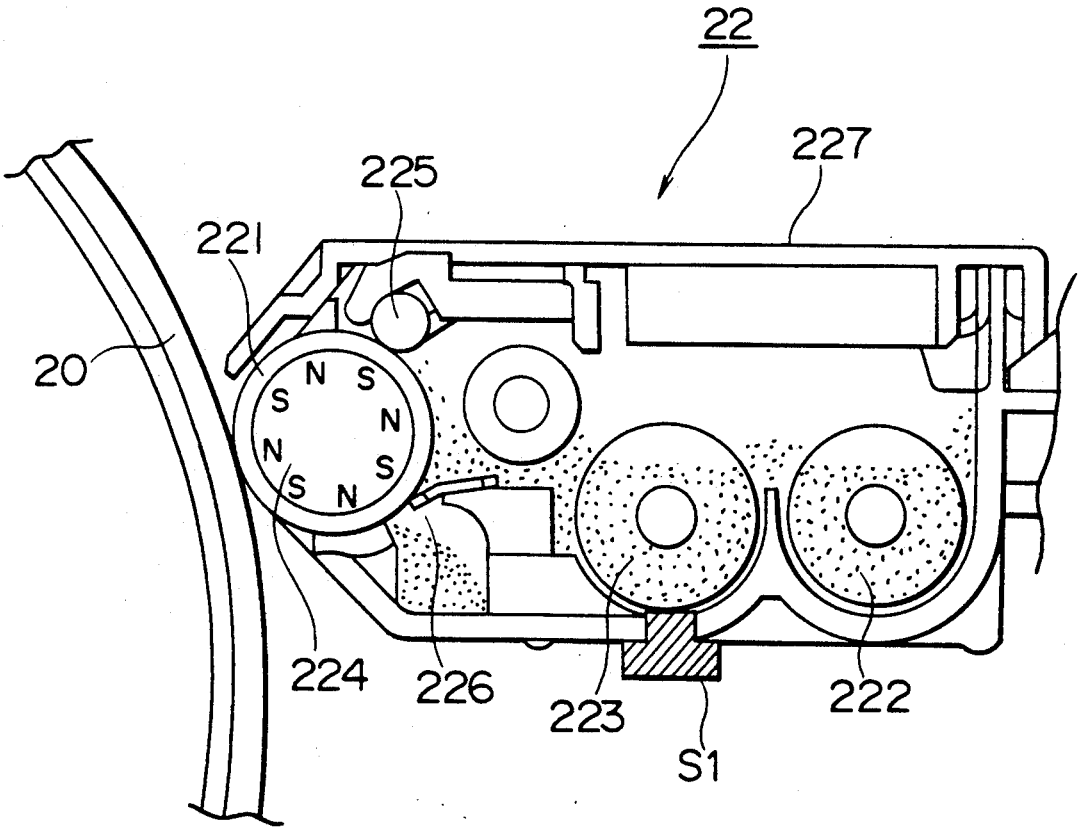
FIG. 2 is a sectional view of a developing means of the aforementioned apparatus.

Next, referring to a sectional view of the developing unit 22 shown in FIG. 2, the structure and function of the developing means will be explained as follows. In this embodiment, the structure and function of the developing units 22Y, 22M, 22C, 22Bk are the same. Consequently, the aforementioned developing units are represented by a developing unit 22, which will be explained as follows.

Inside the developing unit 22 are provided a developing sleeve 221, stirring screws 222, 223, magnetic roller 224, thin layer forming member 225, and scraper 226. A gap formed between the developing sleeve 221 and the photoreceptor drum 20 is always maintained constant by the action of a roller (not shown in the drawing) provided on the same axis as the developing sleeve 221, whereby the gap is maintained to be 0.3–1 mm, and preferably about 0.5 mm.

Stirring screws 222, 223 are stirring members which are rotated in an opposite direction to each other, and toner which is supplied by a toner supply means not illustrated in the drawing, through a supply port 227, is sufficiently mixed with magnetic carrier by the stirring screws. That is, 2-component developer including toner and carrier is sufficiently stirred by the stirring screws 222, 223, so that triboelectric charging is conducted and the developer is made uniform. After that, the developer is supplied to the developing sleeve 221.

The stationary magnetic roller 224 is provided inside the developing sleeve 221, and the thin layer forming member 225 and the scraper 226 are provided around the developing sleeve 221. The magnetic roller 224 is composed of a stationary magnet of 8 poles having the same magnetic force, wherein an N-pole and an S-pole are arranged at regular intervals. In order to form a repulsive magnetic field in the portion where the developing sleeve 221 comes into contact with the scraper 226 so that the developer can be easily scraped off from the developing sleeve 221, one pole is omitted from the magnet. As a result, the magnet is composed of 7 poles as shown in FIG. 2. In general, in order to make the height of bristles low and obtain an appropriate magnetic force, a magnetic roller of 8–16 poles of 300–900 Gauss is preferably used. The thin layer forming member 225 is made of a rigid and magnetic material, and comes into contact with the surface of the developing sleeve 221 with a predetermined pressure.

The developer is supplied by the stirring screws 222, 223 and adhered onto the circumferential surface of the developing sleeve 221, and the adhered developer is formed into a thin layer of 300 μm thick by the thin layer forming member 225. This developer is conveyed by the developing sleeve 221, and develops a latent image formed on the circumferential surface of the photoreceptor drum 20 by means of non-contact reversal development so as to form a toner image.

While the aforementioned non-contact development is conducted, a development bias including an AC component in addition to a DC component is impressed upon the aforementioned developing sleeve 221. As a result, only toner is selectively moved from the developer to the surface of the aforementioned latent image and adhered onto it.

After the toner component in the developer has been consumed and the ratio of carrier has been increased, the developer is conveyed by the developing sleeve 221 and scraped off by the scraper 226 so as to be collected. Then, the collected developer is mixed with new developer, the toner ratio of which is high.

The developing unit 22 is provided with a toner concentration measuring means S1 to measure the concentration (wt %) of toner which is a ratio of toner to carrier, wherein the aforementioned toner concentration measuring means S1 is installed in a position under the stirring screw 223. A permeability detection sensor, capacity detection sensor and reflection concentration meter can be utilized for toner concentration sensor S1.

Figure 3:
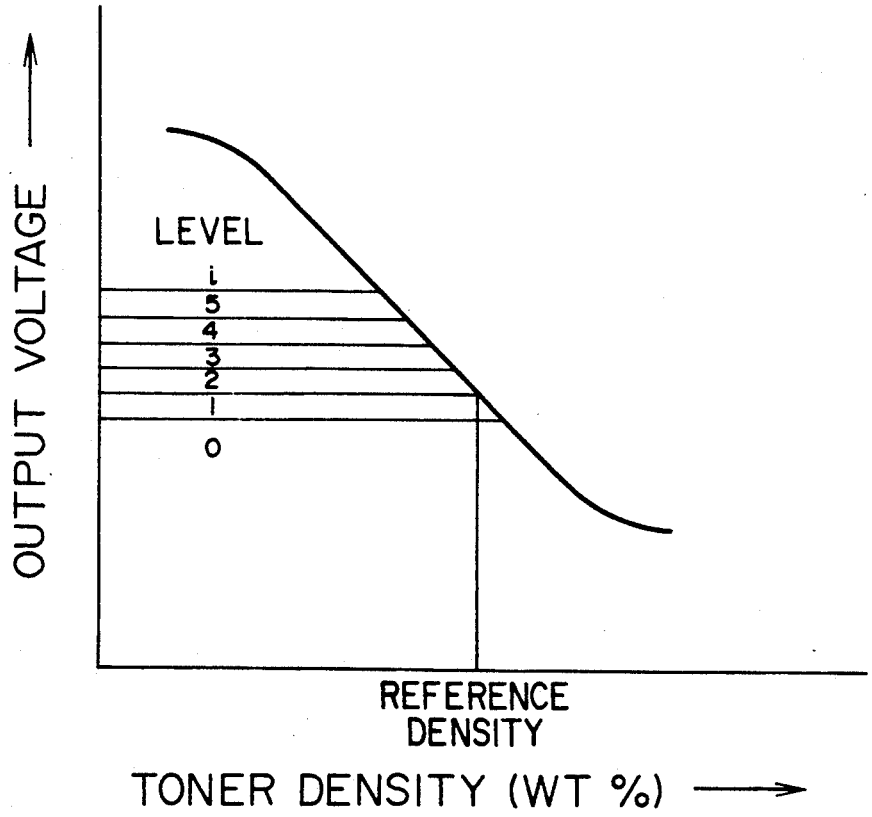
FIG. 3 is a graph showing a relation between the output voltage of a toner concentration sensor and the concentration of toner.
Figure 4:
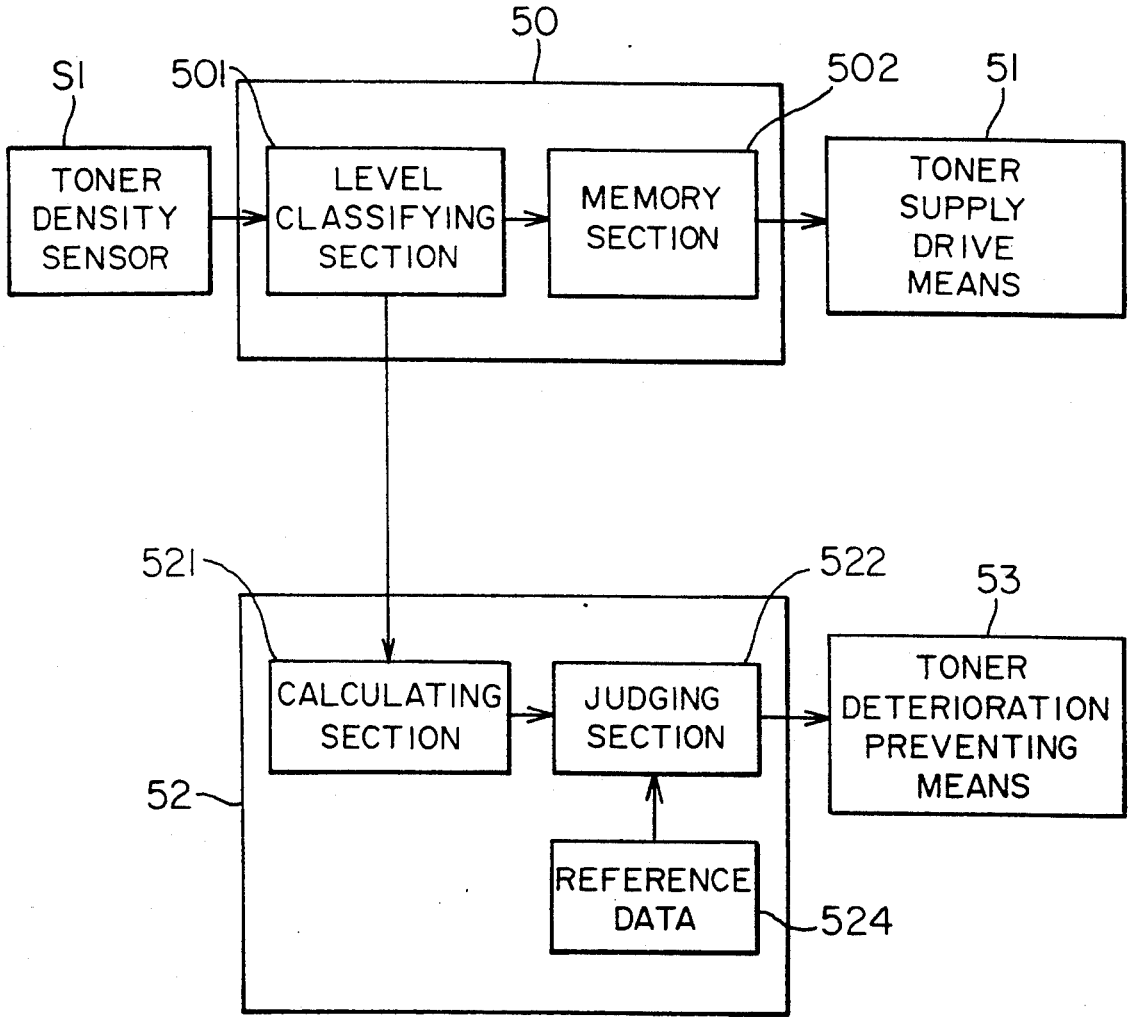
FIG. 4 is a block diagram showing the adjustment of toner concentration and the detection of toner deterioration in the first embodiment of the present invention.

Referring now to FIG. 3 and FIG. 4, toner supply and control of toner concentration will be explained as follows.

FIG. 3 is a graph showing the output voltage of toner concentration sensor S1 and the concentration of toner. As shown in FIG. 3, there is a correlation between the toner concentration and the output voltage of toner concentration sensor S1, so that the toner concentration is controlled according to the output voltage of toner concentration sensor S1 in this embodiment. That is, when toner supply is controlled in accordance with the output of toner concentration sensor S1, toner concentration can be easily adjusted. If a linear region in the graph is utilized for adjustment of toner concentration, the adjustment can be conducted with high accuracy.

FIG. 4 is a block diagram showing the adjustment of toner concentration in the first embodiment. A toner control means 50 comprises a level classifying section 501 and a memory section 502, and controls the toner supply amount according to the level of output voltage inputted from toner concentration sensor S1.

First, the level classifying section 501 of the toner control means 50 classifies the output voltage inputted from toner concentration sensor S1 into several toner levels i (i=0, 1, 2, 3, . . . ). When the output voltage is classified by the level classifying section 501, an approximately linear region shown in FIG. 3 is utilized. The more finely the aforementioned level classification is performed, the more precisely the control of toner concentration can be conducted.

On the other hand, the relation between the aforementioned toner level i shown in Table 1 and drive time ti (i=0, 1, 2, 3, . . . ) of the toner supply means 51, is previously stored, and the toner control means 50 outputs a drive signal to drive the toner supply drive means 51 for the aforementioned drive time $t_i$ according to toner level i which has been classified by the level classifying section 501 of the toner control means 50. In this case, the relation stored in the memory section 502 is determined according to not only the relation between the drive time of the toner supply means 51 and the toner supply, but also the relation between the toner concentration and the output voltage of toner concentration sensor S1, and a circulation time of developer circulated by the stirring screws 222, 223.

Consequently, when the output voltage of toner concentration sensor S1 is low (when the toner concentration is high), the toner control means 50 reduces the time in which a drive signal is outputted into the toner supply drive means 51, and on the contrary, when the output voltage is high (when the toner concentration is low), the toner control means 50 prolongs the time in which the drive signal is outputted. In this case, the toner supply amount per unit time supplied by the toner supply drive means 51 is always maintained constant. Accordingly, when the drive time is controlled, the toner supply amount can be controlled, and further toner concentration can be also controlled.

The toner supply means driven by the toner supply drive means 51 supplies toner stored in a toner hopper (not shown in the drawing) into the developing unit through a supply port 227 of the developing unit with a toner conveyance screw (not shown in the drawing). This toner conveyance screw is driven by a pulse motor and its supply amount per unit time is previously determined. Consequently, when the drive time of the pulse motor is controlled, a necessary amount of toner can be accurately supplied so that the toner concentration can be maintained constant. It should be understood that the toner supply means is not limited to the aforementioned structure.

Table A shows relations between the output voltage obtained from toner concentration sensor S1, and the toner density, level classification, drive time of toner supply drive means and supply amount of toner.

Table A shows the conditions of a specific case, described as follows:

When the toner concentration is 7%, the output voltage is 2 V. A toner sensor (manufactured by TDK) is used which is provided with the voltage control adjusting function which is set in such a manner that: the slope is about −0.35 V/% in the linear region shown in the graph of FIG. 3 expressing the relation between the output voltage and the toner concentration. The output voltage of toner concentration sensor S1 is classified into 7 toner levels (level 0–level 6) by the level classification section 501. The capacity of the toner supply means is 100 mg/sec.

In the aforementioned relation, consideration is given to the characteristic of the developer and the capacity of the developing

TABLE A

| Toner concentration (%) | Output Voltage (V) | Level | Drive Time (sec) | Supply Amount (mg) |
|---|---|---|---|---|
| Not less than 7.3 | Not more than 1.9 | 0 | 0 | 0 |
| 7.3 | 1.9 | 1 | 0.24 | 24 |
| 7 | 2.0 | 2 | 0.48 | 48 |
| 6.7 | 2.1 | 3 | 0.72 | 72 |
| 6.4 | 2.2 | 4 | 0.96 | 96 |
| 6.1 | 2.3 | 5 | 1.20 | 120 |
| 5.8 | 2.4 | | | |
| Not more than 5.8 | Not less than 2.4 | 6 | 1.44 | 144 |

Figure 5:
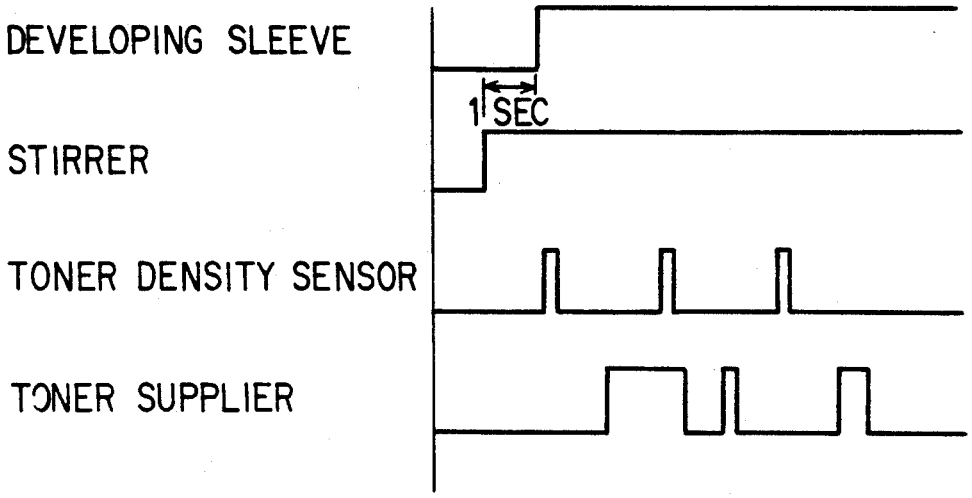
FIG. 5 is a timing chart showing the detection timing of a toner concentration sensor and the toner supply timing.

FIG. 5 is a timing chart showing the timing of detection conducted by the toner concentration sensor and the timing of toner supply. In FIG. 5, each means is driven at a high level.

Toner concentration is measured by toner concentration sensor S1 when the development sleeve 221 is driven synchronously with an electrostatic latent image formed on the photoreceptor drum 20. One second before the development sleeve 221 is driven in the aforementioned manner, the stirring screws 222, 223 are driven, so that the developer has been sufficiently stirred when the toner concentration is measured. Then, the toner supply drive means 51 is driven in accordance with the output voltage of toner concentration sensor S1 and the relation shown on the aforementioned Table A. In FIG. 5, the toner concentration levels of level 6, level 1 and level 2 which have been measured by toner concentration sensor S1, are shown in order from the left, and drive signals are outputted for a period of time (which is shown in Table A) corresponding to each level. In this embodiment, as shown in FIG. 5, the measurement of toner concentration is conducted at the start of development, and after that the measurement is conducted at every 2 seconds, so that the measurement of toner concentration is completed when it has been conducted 3 times per one screen. However, it should be understood that the time of measurement is not limited to the specific embodiments.

As described above, the toner supply amount is controlled according to the toner concentration detected by toner sensor S1, so that the toner concentration can be always maintained constant in the developing unit, too Further, the control of toner concentration is conducted with high accuracy in such a manner that the toner concentration is conducted a plurality of times while one screen of image formation is conducted; or the aforementioned level classification is conducted Consequently a stable image formation can be always conducted.

Next, referring to FIG. 4 and FIG. 6, the detection of deterioration in developer will be explained as follows.

As described above, when the concentration of toner in developer is adjusted, new toner is supplied so that the toner concentration can be always maintained constant. In other words, it can be estimated that the amount of supplied toner is equal to the amount of consumed toner.

The deterioration in developer is detected as follows: First, the level of the output voltage measured by the aforementioned toner concentration sensor S1 is classified by the level classifying section 501 of the toner control means 50. Then, a histogram shown in FIG. 6 of the classified toner level i and the frequency of measurement, is made in a calculating section 521 of the toner deterioration detecting means 52. After a predetermined number of image formation has been completed, the aforementioned calculating section 521 estimates the toner consumption according to the aforementioned toner level i, its frequency and the number of measurement, using the following equation.

$$(\text{Consumption Value}) = \frac{\Sigma\{(\text{Toner Level}) \times (\text{Frequency})}{(\text{Total Frequency})}$$

That is, according to the above equation, the amount of consumed toner (the amount of supplied toner) per one measurement is calculated as the toner consumption value in such a manner that: the number of toner supply is accumulated being weighted in accordance with the toner level (the toner supply); the total amount of consumed toner (the supply) is calculated after a predetermined number of image formation has been conducted; and the total amount of consumed toner (the supply) is divided by the number of measurement. In other words, the calculating section 521 calculates the average of toner consumption (the toner supply) per one measurement of toner concentration.

In this embodiment, the toner level and frequency are multiplied. Of course, the output value of toner concentration sensor S1 may be averaged directly. That is, the average output value may be calculated as a measure to represent a mean consumption amount without using the level classifying section 531 since the relation between toner concentration sensor S1 and toner supply has previously known.

In a judging section 522 of the toner deterioration detecting means 52, the consumption value calculated by the calculating section 521 is compared with a previously set reference value in order to judge whether the toner consumption is low or not. That is, the smaller the aforementioned consumption value is, the smaller the toner consumption is in the developing unit 22, so that the toner remains in the developing unit 22. Consequently, the toner is stirred over a long period of time and deteriorated. On the contrary, when the aforementioned consumption value is high, the toner does not remain in the developing unit 22, so that the toner is not deteriorated.

In this case, the aforementioned reference value is determined in accordance with the characteristic of the developer, the performance of the developing unit, and the like.

Referring now to the histogram illustrated in FIG. 6, the aforementioned detection of deterioration of developer will be explained specifically.

Figure 6:
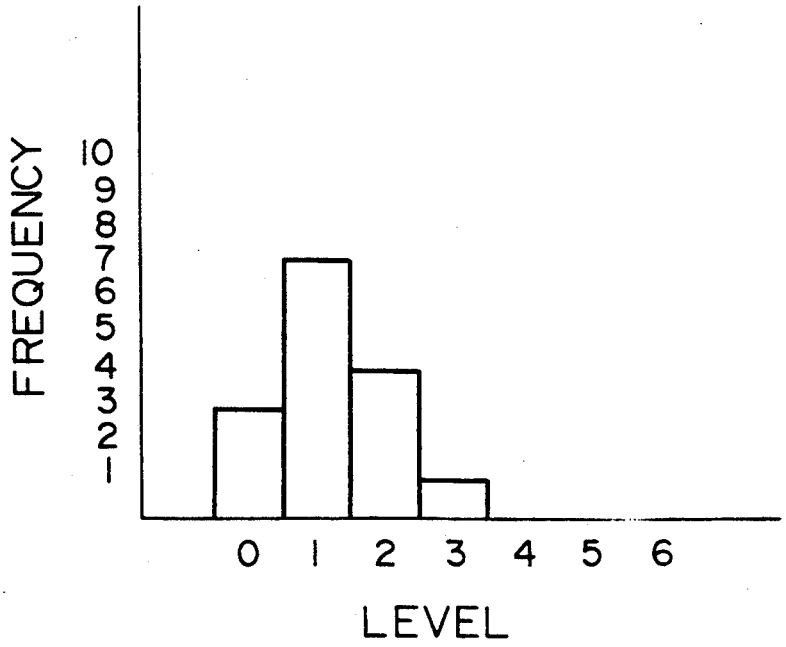
FIG. 6 is a histogram made according to the detection of toner deterioration.

FIG. 6 is a histogram which is obtained by the calculating section 521 when the toner concentration is measured three times on one screen in the same manner as the aforementioned toner concentration adjustment and 5 screens are continuously copied on transfer sheets of A-4 size. The histogram in FIG. 6 was made after 5 screens of images were formed. The frequency of toner level 0 is 3, that of toner level 1 is 7, that of toner level 2 is 4, that of toner level 3 is 1, that of toner level 4 is 0, that of toner level 5 is 0, and that of toner level 6 is 0. Consequently, the consumption value calculated by the calculating section 521 can be expressed by the following equation.

$$\text{(Consumption Value)} = \frac{0 \times 3 + 1 \times 7 + 2 \times 4 + 3 \times 1 + 4 \times 0 + 5 \times 0 + 6 \times 0}{3 \times 5} = 1.2$$

The consumption value 1.2 calculated in the calculating section 521 is inputted into the judging section 522 of the toner deterioration detecting means 52, and compared with the reference value 1.4. In this case, the consumption value 1.2 is smaller than the reference value 1.4, so that it is judged in the judging section 522 that the toner consumption is low. Accordingly, if the toner in the developing unit is deteriorated, the toner deterioration detecting means 52 outputs a deterioration signal to a deterioration preventing means 53 so as to prevent toner deterioration.

The aforementioned reference value 1.4 is an experimental value. When a copy operation of blackening ratio of 2% were repeated under the condition of the reference value of 1.4, influences of developer deterioration such as deterioration in developing property and image density were observed. In this case, the blackening ratio is defined as a ratio of the black image area to all the document area. This kind of ratio is defined not only in the case of black but also in the cases of other color components. Therefore, the aforementioned reference value must be determined, giving consideration to various factors such as the characteristic of developer, that of a developing unit, and the like. However, it should be understood that the reference value is not limited to the aforementioned value of this embodiment. It is preferable to change the reference value according to the screen size (the transfer paper size) on which images are formed. For example, the reference value may be changed according to the ratio of screen size as follows. For example, the area of size A-3 is twice as large as that of size A-4, so that the aforementioned reference value is determined to be 2.8 which is twice as large as the reference value 1.4.

The consumption amount (the supply amount) of toner per unit measuring number is calculated in this embodiment. However, the consumption amount of toner may be calculated as follows. For example, the consumption amount per one copy may be calculated, or the consumption amount per unit drive time of a developing unit may be calculated. In this embodiment, the toner consumption was averaged after 5 copies had been completed. However, it should be understood that the the averaging calculation is not limited to the specific manner. The averaging calculation may be conducted after an arbitrary number of copy operations have been completed such as one copy, 10 copies and 100 copies. The average consumption may be calculated after a predetermined time has passed.

Next, the toner deterioration preventing means 53 will be explained as follows.

When it is judged by the aforementioned toner deterioration detecting means 52 that the toner consumption amount is low in the developing unit 22, the toner deterioration preventing means 53 is driven.

Specifically, the toner deterioration preventing means 53 is driven as follows:

A band-shaped latent image is formed on the non-image portion of the photoreceptor drum 20, and then the latent image is developed. This toner image is not transferred onto a transfer sheet but conveyed to the following process of cleaning. When the latent image is removed from the surface of the photoreceptor drum 20 by the cleaning means 23, the deteriorated toner remaining in the developing unit 22 can be discharged.

Figure 7:
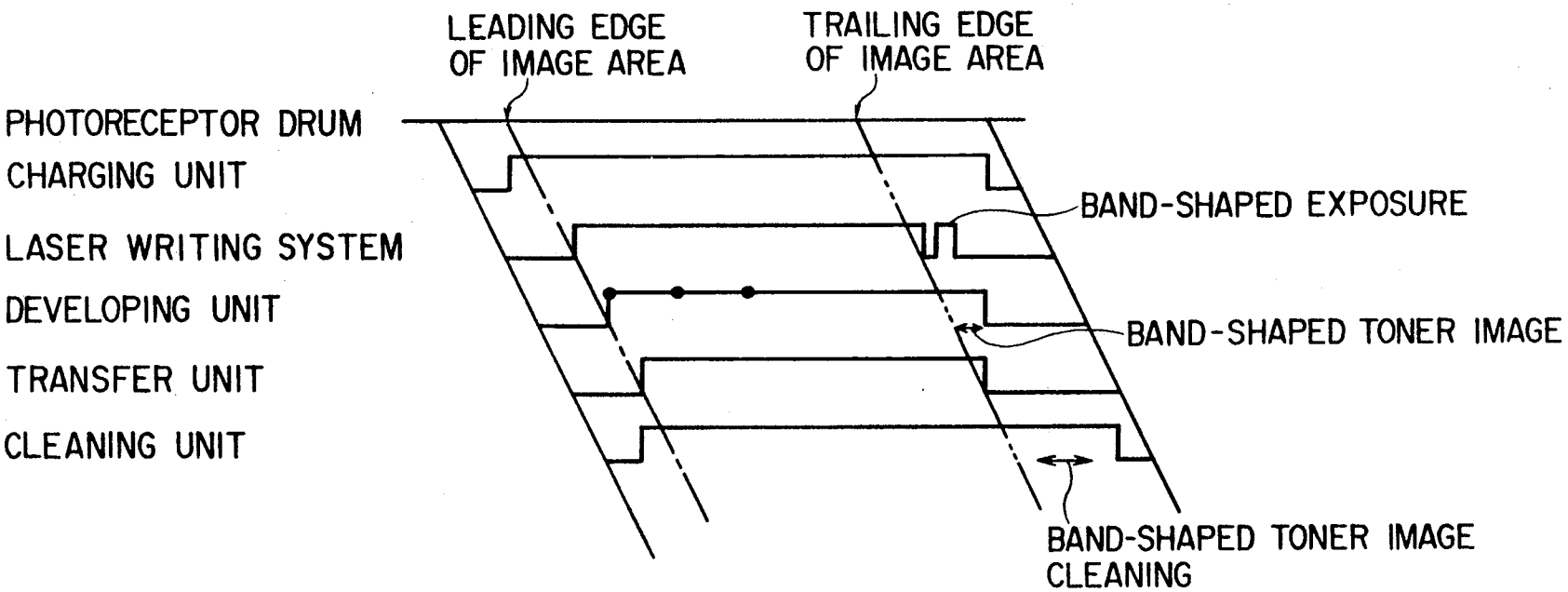
FIG. 7 is a timing chart showing a model of the operation of a toner deterioration preventing means.

FIG. 7 is a schematic illustration of a timing chart of the toner deterioration preventing means 53. In FIG. 7, the developing unit 22 is taken up for an example, and the timing of charging, exposure, development, transfer and cleaning is shown in relation to the operation of the developing unit. A one-dotted chain line represents the timing of the leading edge of the image portion, and a two-dotted chain line represents the trailing edge of the image portion. Mark "·" represents the timing to measure the concentration of toner by the aforementioned toner concentration sensor S1.

After the surface of the photoreceptor drum 20 has been uniformly charged by the charging unit 21, image exposure of the first color is conducted by laser writing system B so that a latent image is formed. When the toner is deteriorated, for example, a portion of the non-image area which is separated from the trailing edge of the image portion by 20 mm, is exposed in a band-shape by laser writing system B, so that a band-shaped latent image is formed.

On the other hand, latent images are successively developed by the developing unit 22. At this time, the toner concentration is measured. According to the results, the toner concentration is adjusted in the manner described above. When it is judged by the toner deterioration detecting means 52 that the toner has been deteriorated, the aforementioned band-shaped latent image is formed. On the contrary, when it is judged that the toner has not been deteriorated yet, the aforementioned band-shaped latent image is not formed. The formed band-shaped latent image is visualized by the developing unit 22 successively after an objective latent image has been visualized.

The toner image of the image portion is transferred by the transfer unit 24 onto a transfer sheet which is conveyed. Concerning the aforementioned band-shaped toner image, the operation of the transfer unit 24 is stopped so that the transfer operation can not be conducted, and then the band-shaped toner image is conveyed to the cleaning means 23 being held on the surface of the photoreceptor drum 20.

In order to remove the residual toner on the objective image portion and the toner on the band-shaped toner image portion, the cleaning blade 231 which has been separated from the surface of the photoreceptor drum 20, is contacted with it so that a cleaning operation is conducted.

According to the experimental results, it could be confirmed that: when the aforementioned band-shaped latent image was formed so that about 40 mg of toner was adhered, the deteriorated toner in the developing unit 22 could be sufficiently removed. Of course, the present invention is not limited to the specific values.

The toner deterioration preventing means 53 shown in this embodiment is preferable in which a band-shaped toner image is formed in the non-image portion according to the result of toner deterioration detection and the deteriorated toner is removed from the developing unit 22. However, instead of the aforementioned toner deterioration preventing means, the following means may be adopted in which the drive time of the stirring screws 222, 223 of the developing unit 22 is reduced or the stirring speed is lowered so that the deterioration of toner can be prevented.

Since the structure and function of the developing units 22Y, 22M, 22C, 22Bk illustrated in FIG. 1 are all the same, adjustment of toner concentration, detection of toner deterioration and prevention of toner deterioration have been explained above with regard to one developing unit 22 as an example. The aforementioned adjustment of toner concentration, detection of toner deterioration and prevention of toner deterioration are conducted in each of the developing units 22Y, 22M, 22C, 22Bk.

Figure 8:
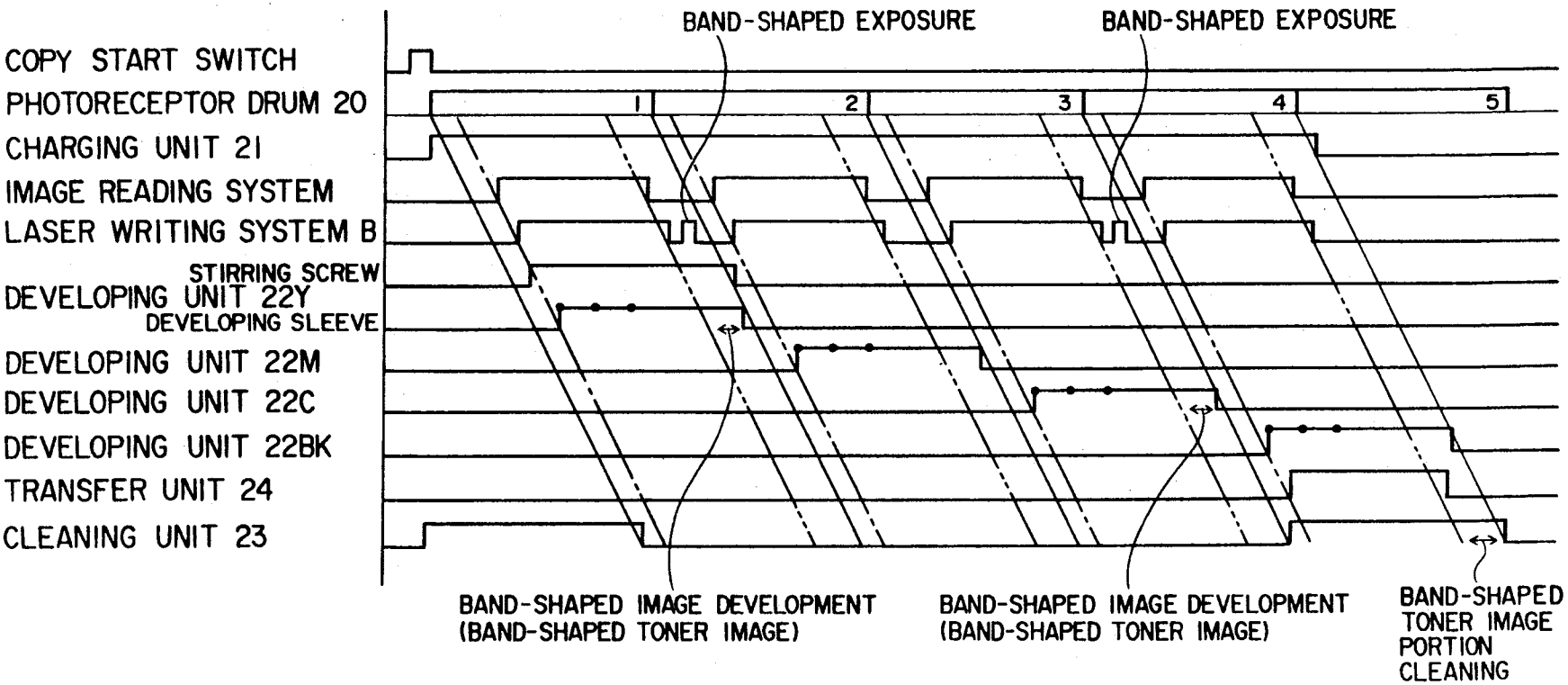
FIG. 8 is a timing chart showing image formation conducted by a color copier to which the present invention is applied.

FIG. 8 shows a timing chart to obtain an image by a color copier illustrated in FIG. 1. A one-dotted chain line represents the timing of the leading edge of the image portion, and a two-dotted chain line represents the trailing edge of the image portion. Mark "~" represents the timing to measure the concentration of toner by the toner concentration sensor. The timing chart in FIG. 8 is made under the condition that: a document placed on the platen 11 is copied only by one; detection of toner concentration is conducted 3 times with regard to one image; and the operation of detection of toner deterioration and prevention of toner deterioration are performed at each image.

First, a document is placed on the platen 11, and a copy button (not shown in the drawing) on an operation panel (not shown in the drawing) is pressed. Then, the photoreceptor drum 20 is rotated, and the surface of the photoreceptor drum 20 is uniformly charged by the charging unit 21. On the other hand, a portion of the photoreceptor drum surface which is going to be charged, is cleaned by the cleaning means 23.

After that, a latent image is formed as follows:

An index sensor provided to a specific position on the photoreceptor drum 20, is detected so that image reading system A is driven. The image of the document is read out by the color CCD 142. A yellow image signal corresponding to the first color is exposed on the photoreceptor drum 20 which has been uniformly charged by laser writing system B, so that a latent image is formed.

The aforementioned latent image is developed by the developing unit 22Y so that a toner image can be formed on the photoreceptor drum 20. At a position indicated by mark "·" in the timing chart, the toner concentration is detected by toner concentration sensor S1Y provided in the developing unit 22Y. In accordance with the detected toner concentration value, yellow toner for supply use is fed into the developing unit 22Y. The aforementioned toner concentration detection is conducted 3 times. The detected values are weighted by the toner deterioration judging means 52 as described above and the averaged toner consumption value is calculated. In the judging section 522, the found toner consumption value is compared with a reference value which has been previously set, so that the deterioration of toner can be judged. In the case shown in FIG. 8, the yellow toner supply amount (the consumption amount) is small, so that a band-shaped exposure is performed in a position separated from the trailing edge of the latent image. This band-shaped exposure portion is developed by the developing unit 22Y so that a band-shaped yellow toner image can be formed on the photoreceptor drum 20. The objective yellow toner image and the band-shaped toner image are conveyed by the photoreceptor drum 20, and passed through under the cleaning means 23 which is separated from the surface of the photoreceptor drum 20. Then, the process enters into the image formation of a magenta toner.

The image formation of magenta toner image is performed in the same manner as the aforementioned yellow toner image. That is, charging, exposure and development are conducted so that a magenta toner image is formed synchronously with the yellow toner image under the presence of the yellow toner. When the magenta toner image is formed, the measurement of concentration, the supply of magenta toner and the detection of toner deterioration are conducted with regard to magenta toner, and the toner deterioration preventing means 53 is driven, if necessary. In the timing chart illustrated in FIG. 8, a case is shown in which the consumption of magenta toner is more than the reference value so that a band-shaped exposure is not conducted by laser writing system B. After the magenta toner image is formed on the photoreceptor drum 20, the next image formation is started.

After the image formation of magenta toner, the image formation of cyan and black toner is conducted in the same manner as the aforementioned image formation of yellow and magenta toner. In the case shown in FIG. 8, it is judged by the toner deterioration judging means 52 that the consumption amount of cyan toner is smaller that the reference value, so that a band-shaped exposure is conducted on a position separated from the trailing edge of the cyan toner image so as to form a band-shaped toner image and to prevent toner deterioration. In the case of black toner, the consumption amount is larger than the reference value, so that a band-shaped toner image formation is not conducted.

In the manner described above, toner images of yellow, magenta, cyan and black are superimposed on the photoreceptor drum 20 so that a color toner image can be formed. This color toner image is transferred by the transfer unit 24 onto a transfer sheet conveyed synchronously with the rotation of the photoreceptor drum 20. On the other hand, band-shaped toner images of yellow and cyan, the toners of which are judged to have been deteriorated, are formed in a position separated form the color toner image. The charging unit 24 does not work on the aforementioned band-shaped toner images. Therefore, when the transfer operation has been completed, there are the residual toner which has been left on the surface of the photoreceptor drum 20 after the transfer of the color toner image, and the band-shaped toner images. These toners are removed by the cleaning means 23, and a new image formation process is started.

In this embodiment, right after an image has been formed according to an image signal, the toner deterioration preventing means 53 is driven, in other words, a band-shaped latent image is formed and developed into a toner image in a non-image portion at each color. However, the present invention is not limited to the specific embodiment. For example, after toner images of Y, M, C have been formed and then a BK latent image has been formed, a band-shaped latent image may be formed in order to prevent the deterioration of toner. In this case, latent image formation of each color is performed in such a manner that: the position of latent image formation is changed at each color, and the developing units 22Y, 22M, 22C, 22Bk are driven synchronously with the aforementioned position.

In this embodiment, 2-component developer is utilized which is composed of toner and carrier. Of course, one-component developer composed of only toner may be utilized.

Next, the second embodiment of the present invention will be explained as follows. Explanations of like units in each of the first and second embodiment will be omitted here.

Figure 9:
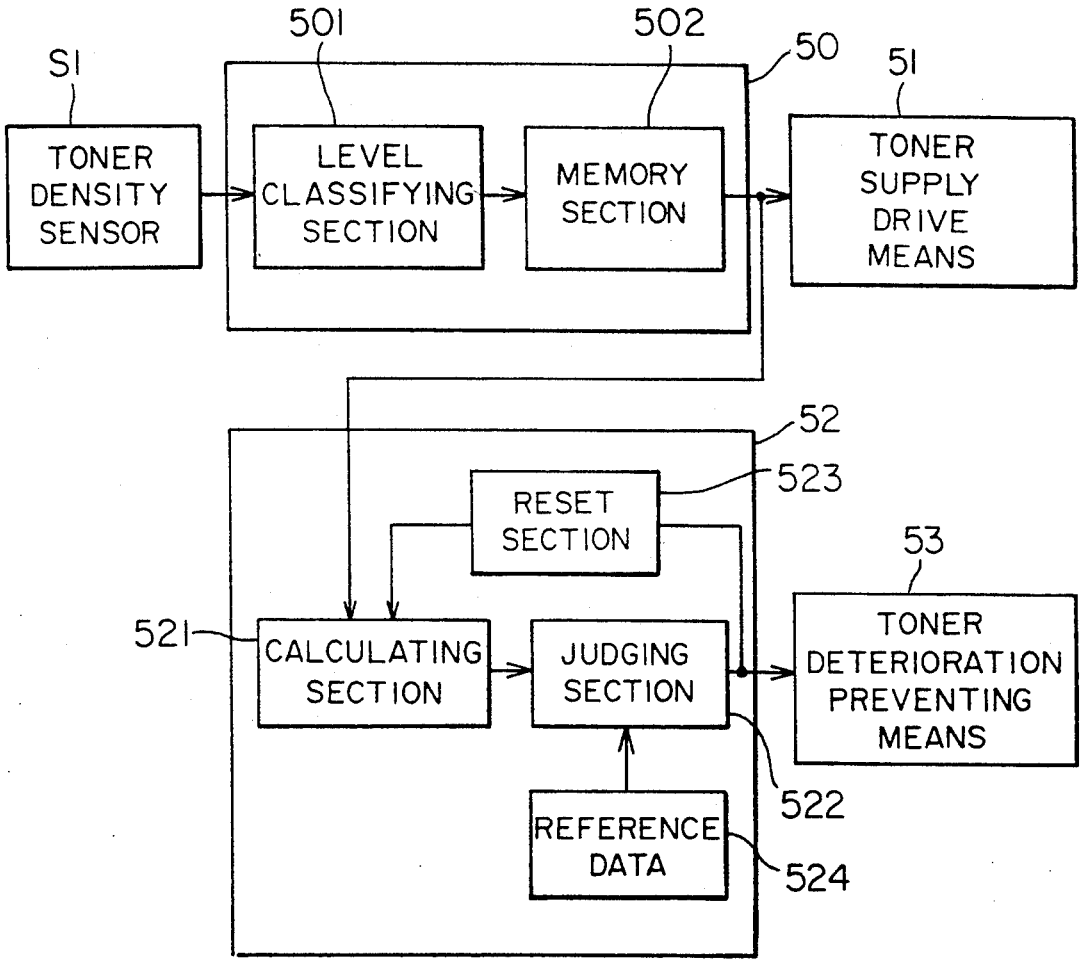
FIG. 9 is a block diagram showing the adjustment of toner concentration and the detection of developer deterioration in the second embodiment of the present invention.

FIG. 9 is a block diagram showing the adjustment of toner concentration. Numerals attached to the blocks in FIG. 8 correspond to those in FIG. 4 which illustrates the first embodiment. In the first embodiment, the output of the level classifying section 501 is inputted into the calculating section 521. On the hand, in the second embodiment, the output (the drive time signal) of the memory section 502 is inputted into the calculating section 521. In the same manner as the first embodiment, in FIG. 8 showing the second embodiment, the toner supply means 51 is driven according to the output of the memory section 502 so that the toner concentration can be always maintained constant. In other words, it can be estimated that the supplied toner amount is the same as the consumed toner amount.

When the deterioration of developer is detected, drive time $t_i$ which is outputted into the toner supply drive means 51 in accordance with toner level i classified by the toner control means 50; is also outputted into the toner deterioration detecting means 52 so that drive $t_i$ can be inputted into the calculating section 521 in the toner deterioration detecting means 52. In the calculating section 521, the total of the aforementioned drive time $t_i$ is calculated. After images have been formed at predetermined times (after the concentration has been measured at predetermined times), the toner supply capacity of the toner supply means (in Table 1, the toner supply capacity is 100 mg/sec) is multiplied by the aforementioned total, and then the obtained value is divided by the frequency of toner concentration measurement so that the consumption value can be calculated. That is, the toner consumption value per unit measurement frequency can be calculated by the following equation.

$$\text{(Consumption Value)} = \frac{\text{(Supply Capacity)} \times \Sigma\text{(Drive Time ti)}}{\text{(Number of Measurement)}}$$

In other words, the calculating section 521 calculates the average of toner consumption amount (the toner supply amount) per toner concentration measuring frequency.

In the judging section 522 of the toner deterioration detecting means 52, the consumption value calculated in the calculating section 521 is compared with the reference value which has been previously set, and it is judged whether the toner consumption value is low or not. That is, the smaller the aforementioned consumption value is, the smaller the toner consumption in the developing unit 22 is. Accordingly, the toner stays for a longer time in the developing unit 22, and is stirred over a longer period of time, so that the toner is necessarily deteriorated. On the contrary, the larger the aforementioned consumption value is, the larger the toner consumption amount is. Accordingly, the toner does not stay in the developing unit 22, so that the deterioration of toner does not occur.

When it is judged that the toner in the developing unit has been deteriorated, the toner deterioration detecting means 52 outputs a deterioration signal to the toner deterioration preventing means 53, so that toner deterioration can be prevented.

After judgement has been conducted in the judging section 522, the signal is sent to the reset section 523, too, so that the aforementioned total calculated in the calculating section 521 is reset, and the total of drive time ti is calculated again.

The structure and function of the toner deterioration preventing means 53 of this embodiment is the same as those of the first embodiment, so that the explanations will be omitted.

Referring now to the attached drawings, the third embodiment of the present invention will be explained in detail.

Figure 10:
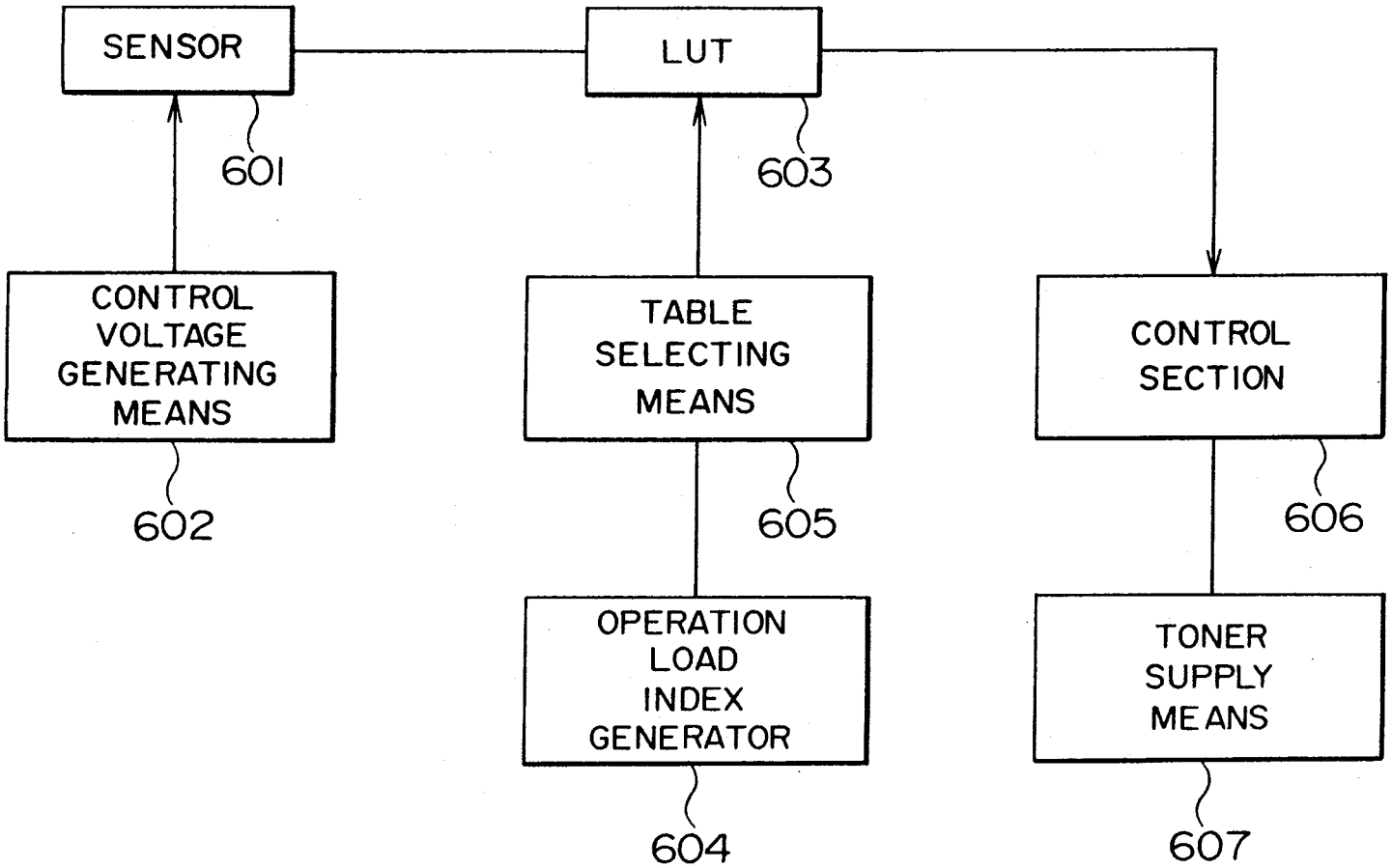
FIG. 10 is a view showing the structure of a control system of a developing unit of the third embodiment according to the present invention.

FIG. 10 is a view showing the electrical structure of the image forming apparatus of the third embodiment according to the present invention.

FIG. 10, numeral 601 is a sensor which detects the toner concentration of developer by sensing inductance change of a search coil. Numeral 602 is a control voltage generating means which impresses a control voltage so that the sensor 601 can generate a predetermined output voltage. Number 603 is a lookup table (LUT) means which compares the output voltage of the sensor 601 with the data in the table and outputs toner supply time. In the LUT 603, there are provided a plurality of tables corresponding to the change of the characteristics of the developer according to the number of use. Number 604 is a using condition detecting means which detects the condition of use of the developer, for example, the accumulated number of image forming. Number 605 is a table selecting means which selects a table to be used from the LUT 603 according to the results of detection. Numeral 606 is a control section which controls toner supply according to the output of LUT 603. Numeral 607 is a toner supply means which supplies toner into developer in accordance with the command sent from the control section 606.

The apparatus of this embodiment is structured in the manner described above. The operation will be described as follows.

When a command of initial setting is given, the stirring means in the developing unit starts to stir developer, the concentration of which is set to a reference concentration, for a predetermined period of time (in other words, until toner and carrier are sufficiently mixed).

After the developer has been stirred for a predetermined period of time, the control voltage generating means 602 controls the control voltage impressed upon the sensor 601 so that the output voltage of the sensor 601 can become a predetermined value (for example 1.9 V). After that, the control voltage generating means 602 generates a constant control voltage.

In this case, when the toner in the developer is consumed, the output voltage of the sensor 601 is increased. Consequently, the drive time (which is proportional to the toner supply amount) of the toner supply motor of the toner supply means 607 is obtained from the output voltage of the sensor 601 using LUT 603.

For a certain period of time after the initial setting has been conducted (for example, until 5000 copies have been completed at each color), toner concentration control is conducted using Table 1 shown in FIG. 1. Consequently, when the toner has been consumed and the output voltage of the sensor 601 has exceeded 1.9 V, the toner supply motor of the toner supply means 607 is driven for a period of time corresponding to the output of LUT 603 and toner supply is performed. For example, data is sampled three times from the sensor 1 every 2 seconds at each time when one copy operation has been conducted, and toner supply is performed for 6 seconds at the maximum, in other words, toner is supplied 3 times for 2 seconds.

When the number of copies exceeds 5000, the state of developer such as bulk density is varied, so that the table selecting means 605 which receives the data of copy number from a copy sheet counter, selects and uses Table 2 (which is shown in FIG. 12) in LUT 603 to determine the drive time of the toner supply motor. That is, even though the toner density of the developer is appropriate, the bulk density is increased, so that the output voltage of the sensor 601 is increased. Accordingly, the entire output voltage data on the Table 1 is shifted by 0.15 V in the Table 2 for the purpose of compensation. Due to the foregoing, a proper amount of toner (proper concentration) can be supplied even when the bulk density of developer varies.

In the same manner, at each 5000 copies, the table selecting means 605 successively selects tables shown in FIG. 13 and FIG. 14. The number of copies referred in the above explanation can be found by a counter provided in the developing unit of each color.

Experiments were conducted on the aforementioned conditions. As a result, the toner concentration could be controlled to 7±0.3% when the proper toner concentration of each color was 7%. Due to the foregoing, the balance of colors was maintained in a good state when color copy was conducted.

In the above explanation, a plurality of tables in which the data of output voltage of the sensor was changed, were prepared. A plurality of tables in which the data of motor drive time is changed, may be prepared instead. The content of each table in LUT 603 may be determined according to the characteristic of developer, which is defined as the variation of voltage detected by the sensor when the developer is used. LUT 603 may be prepared in such a manner that the number of copies may be changed at each color according to the kind of developer. In this embodiment, the apparatus is used in which developer is replaced at each 20,000 copies, so that the data corresponds to 20,000 copies. Replacement of developer may be determined according to the kind of developer.

Figure 15:
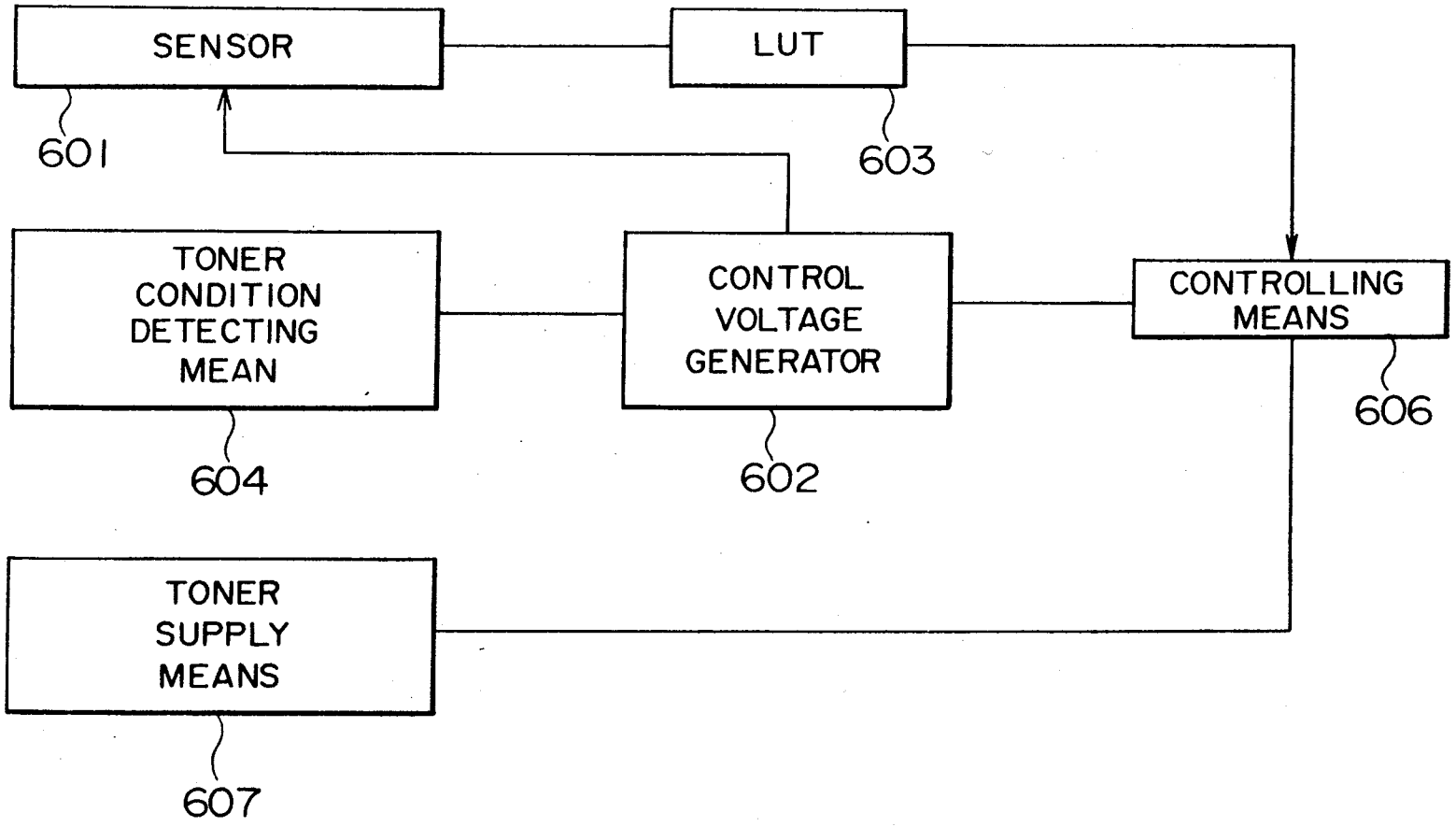
FIG. 15 is a view showing the structure of a control system of a developing unit of the fourth embodiment of the present invention.
Figures 20, 21:
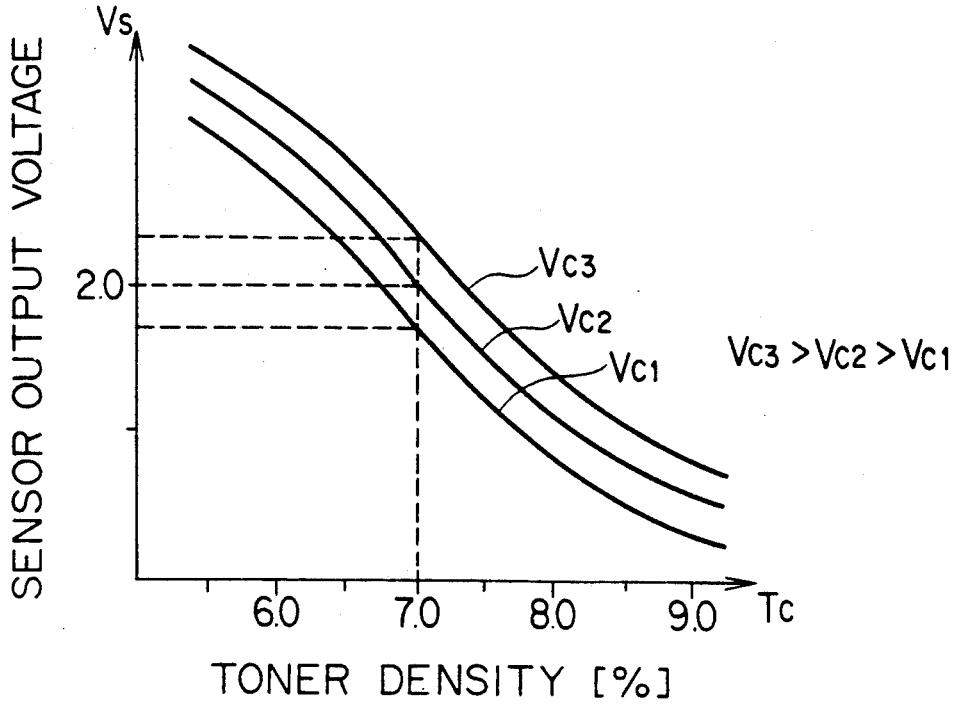
FIG. 20 is a schematic illustration showing the content of Table 4' used under a condition of high temperature and humidity.
FIG. 21 is a characteristic diagram showing the characteristic of a sensor which detects toner concentration.

FIG. 15 is a view showing the structure of the fourth embodiment of the present invention. This embodiment is different from the embodiment shown in FIG. 10 in the point that the control voltage generating means 602 generates a control voltage to the sensor 601 in accordance with the result of detection conducted by the using condition detecting means 602. In LUT 603, one kind of table which is the same as that of a preceding embodiment structure, is provided.

In this structure, a control voltage impressed upon the sensor 601 is changed in accordance with the number of use of each color developer so that a constant sensor output can be obtained with regard to the toner concentration of developer.

According to the result of measurement conducted on a developer, a predetermined output was obtained in such a manner that: the data in Table 1 shown in FIG. 11 was used for the data in the LUT 603; and the control voltage to control the sensor 601 was set to 7.02 V in the initial setting (the toner concentration is 7%). When the number of copies exceeded 5000, the control voltage was set to 6.94 V, and the same result was obtained.

Accordingly, as illustrated in FIG. 16, the control voltage generating means 602 impresses a control voltage which decreases by 0.08 V at each 5000 copies, upon the control terminal of the sensor 601.

Experiments were conducted on the aforementioned conditions. As a result, the toner concentration could be controlled to 7±0.3% when the proper toner concentration of each color was 7%. Due to the foregoing, the balance of colors was maintained in a good state when color copy was conducted.

A ratio of change of control voltage may be determined according to the characteristic of developer.

In both the third and fourth embodiment, the control accuracy can be further improved when the sensor output voltage in the LUT 603 is previously shifted with regard to the output voltage in a table to be used, according to the temperature and humidity in the developing unit. Preferably, the control accuracy can be improved in such a manner that: the output voltage of the sensor utilized in the aforementioned embodiment under the condition of high temperature and humidity, is shifted with regard to the data in FIG. 11 to FIG. 14 as shown in FIG. 17 to FIG. 20 (In the case of the fourth embodiment, only FIG. 18 is utilized.).

The aforementioned 2 kinds of embodiments are composed in such a manner that: data in the LUT 603 such as a table and a control voltage is changed according to the number of copies. However, other compositions can be adopted. For example, since the amount of used toner can be estimated by the accumulated value of the time in which the toner supply motor of the toner supply means 607 was rotated, selection of a table and change of a control voltage can be conducted according to the aforementioned accumulated value. In this case, toner concentration can be controlled more accurately.

It is possible to refer to the reflecting density of a toner image on the photoreceptor in determining the control voltage shift. Further, it is possible to refer to the temperature and humidity in the image forming apparatus in accordance with the characteristic of developer. In the case of an image forming apparatus in which a CCD is utilized, it is possible to refer to the output signal of the CCD.

The object of the aforementioned embodiment is to maintain the toner concentration constant. When it is required to positively change image density, the toner concentration can be changed by adjusting the drive time of the table and motor.

As explained above, the apparatus of the third and fourth embodiment comprise: a sensor which detects the toner concentration in developer including magnetic carrier and non-magnetic toner as a change of permeability which changes according to magnetic carrier weight in unit volume of developer; a using state detecting means which detects the using state of developer; and a control means which adjusts the control level according to the using state of developer and controls toner supply.

Due to the foregoing, when toner is supplied according to the output of a sensor which detects the concentration of toner, the control level (the toner supply time and control voltage to be applied to the sensor) can be selected in accordance with the developer using state which is detected by the using state detecting means.

As explained in detail, the present invention is to provide an image forming apparatus which is characterized in that: the supply amount of developer to be supplied to the developing means is defined as the consumption amount of developer; and the deterioration of developer is detected according to the average of the consumption amount of developer.

As described above, the image forming apparatus of the present invention judges the deterioration of developer in such a manner that the conventional developer supply means is utilized; the supply amount is defined as the consumption amount; and the deterioration of developer is judged according to the average of the consumption amount. Consequently, the deterioration of developer can be easily and accurately judged. Deterioration of developing performance, image quality and color reproducibility can be prevented and a developing operation can be always performed stably.

What is claimed is:

1. A color image forming apparatus having a latent image forming unit, a plurality of developing units containing toner of respective colors included in developer for respectively developing latent images formed by the latent image forming unit into toner images so as to form a color image by a superposition of the toner images in an image area of a surface of image carrying member, a transfer unit for transferring the color image onto a recording sheet, a cleaning unit for removing residual toner from the surface after the transfer and a plurality of supplying units for respectively supplying the toner of the respective colors into corresponding developing units, the color image forming apparatus comprising:

means for measuring toner density of the developer contained in each developing unit, the toner density representing toner content in the developer;

means for calculating average toner consumption of the developing unit averaged over a predetermined operation period of the developing unit based on data of the toner density accumulated during the same period;

means for storing standard toner consumption data; and means for detecting deterioration of the developer in the developing unit by comparing the average toner consumption with the standard toner consumption data.

2. The image forming apparatus of claim 1, further comprising means for controlling each of the latent image forming unit, the developing units, the transfer unit and the cleaning unit, so that, when the detecting means detects the deterioration of the developer in the developing unit, the toner of the developer is forcibly removed from the same developing unit.

3. The image forming apparatus of claim 2, wherein, when the detecting means detects the deterioration of the developer in the developing unit, the controlling means controls, so that:

the latent image forming unit forms a band-shaped latent image in a band area outer of the image area;

the developing unit develops the band-shaped latent image into a band-shaped toner image;

the transfer unit transfers the color image without contacting the band area so as to leave the band-shaped toner image on the surface; and the cleaning unit removes the residual toner and the toner of the band-shaped toner image from the surface after the transfer.

4. The image forming apparatus of claim 1, wherein the calculating means comprises:

means for converting the toner density to a toner density level selected from a plurality of predetermined toner density levels;

means for accumulating data of the toner density level, which summarizes the data of the toner density level into a frequency distribution data of the toner density level; and means for estimating the mean consumption amount by calculating a mean density level based on the frequency distribution data.

5. A color image forming apparatus having a latent image forming unit, a plurality of developing units containing toner of respective colors included in developer for respectively developing latent images formed by the latent image forming unit into toner images so as to form a color image by a superposition of the toner images in an image area of a surface of an image carrying member, a transfer unit for transferring the color image onto a recording sheet, a cleaning unit for removing residual toner from the surface after the transfer and a plurality of supplying units for respectively supplying the toner of the respective colors into the developing units, the color image forming apparatus comprising:

means for measuring toner density in each developing unit, the toner density meaning toner content of the developer;

drive control means for controlling a supply time period of each supplying unit based on the toner density measured in each developing unit;

means for calculating average toner supply to each developing unit based on data of the drive time periods having been measured by a predetermined number of measurements in each developing unit;

means for memorizing reference data including standard toner consumption data; and means for detecting deterioration of the developer contained in the developing unit based on a comparison of the average toner supply with the standard toner consumption data.

6. The image forming apparatus of claim 5, further comprising means for controlling the latent image forming unit, the developing means, the transfer unit and the cleaning unit, so that, when the detecting means detects the deterioration of the developer in the developing unit, the toner is forcibly removed out of the same developing unit.

7. The image forming apparatus of claim 6, wherein, when the detecting means detects the deterioration of the developer contained in the developing unit, the controlling means controls, so that:

the latent image forming unit forms a band-shaped latent image on the surface in a band area other than the image area;

the developing means develops the band-shaped latent image into a band-shaped toner image;

the transfer unit keeps the band-shaped toner image without contacting the band area in the transfer of the color image; and the cleaning unit removes the toner of the band-shaped toner image from the surface.

8. The image forming apparatus of claim 5, wherein the calculating means calculates a total drive time of the supplying means as a sum-up of each drive time, a total toner supply amount as a multiplication of the total drive time by a supply rate of the supplying unit, and further calculates the average toner supply amount as the total toner supply amount divided by the total drive time.

9. An image forming apparatus having latent image forming means for forming a latent image in an image area of a surface of an image carrying member, developing means for developing the latent image to form a toner image, transfer means for transferring the toner image on a recording sheet and cleaning means for removing residual toner from the surface, the image forming apparatus comprising:

means for recursively measuring toner density of developer contained in the developing means;

means for storing reference data including standard toner consumption data;

means for calculating an average toner consumption consumed by the developing means based on data of the toner density accumulated from recursive measurements by the measuring means; and means for detecting deterioration of the developer in the developing means by comparing the average toner consumption with the standard toner consumption data.

10. The image forming apparatus of claim 9, further comprising means for controlling the latent image forming means, the developing means, the transfer means and the cleaning means, so that, when the detecting means detects the deterioration of the developer:

the latent image forming unit forms a band-shaped latent image on the surface in a band area other than the image area;

the developing means develops the band-shaped image into a band-shaped toner image;

the transfer means leaves the band-shaped toner image on the surface while transferring the toner image; and the cleaning means cleans the surface after the transfer, so as to remove the band-shaped toner image from the surface.

11. The image forming apparatus of claim 9, wherein the calculating means comprises:

means for converting the toner density into a corresponding toner level selected from a plurality of predetermined levels;

means for summarizing accumulated data of the toner density level to form a frequency distribution data;

means for obtaining the average toner supply from the frequency distribution data by the steps of multiplying each toner density level by its frequency, summing up multiplication results and dividing the summation by number of total measurements by the measuring means.

12. An image forming apparatus provided with a latent image forming unit for forming a latent image in an image area of a surface of an image carrying member, a developing unit for developing the latent image to form a toner image, a supply unit for supplying toner of developer into the developing unit, a transfer unit for transferring the toner image onto a recording sheet and a cleaning unit for removing residual toner from the surface after the transfer, the image forming apparatus comprising:

means for measuring toner density of the developer in the developing unit;

means for generating a drive control signal, which measures toner content of developer contained in the developing unit and generates the drive control signal based on the toner density;

drive control means responsive to the drive control signal for controlling a driving period of the supply unit;

memory means for memorizing reference data of toner consumption by the developing unit;

calculating means for calculating a consumption amount of toner consumed by the developing unit based on the driving period;

detecting means for detecting the deterioration of the developer contained in the developing unit by comparing the calculated consumption amount with the reference data;

control means for making the toner adhere to the surface from the developing unit when the detecting means detects the deterioration of the developer.

13. The image forming apparatus of claim 12, wherein the control means controls the latent image unit, the developing unit, the transfer unit and the cleaning unit, so that, when the detecting means detects the deterioration of the developer:

the latent image forming unit forms a band-shaped latent image in an area other than the image area;

the developing unit develops the band-shaped latent image into a band-shaped toner image;

the transfer unit keeps the band-shaped toner image while transferring the toner image.

* * * * *